US005995127A

United States Patent [19]

Uzuka

[11] Patent Number: 5,995,127

[45] Date of Patent: Nov. 30, 1999

[54] THERMAL PRINT HEAD AND MANUFACTURING METHOD THEREOF

[75] Inventor: Ryuichi Uzuka, Yokohama, Japan

[73] Assignee: Kabushiki Kaisha Toshiba, Japan

[21] Appl. No.: 08/793,300

[22] PCT Filed: Sep. 13, 1995

[86] PCT No.: PCT/JP95/01818

§ 371 Date: Mar. 12, 1997

§ 102(e) Date: Mar. 12, 1997

[87] PCT Pub. No.: WO96/08829

PCT Pub. Date: Mar. 21, 1996

[30] Foreign Application Priority Data

Sep. 13, 1994 [JP] Japan ..... 6-218381
Jun. 27, 1995 [JP] Japan ..... 7-160540

[51] Int. Cl.[6] ..... B41J 2/335

[52] U.S. Cl. ..... 347/204; 29/611

[58] Field of Search ..... 347/200, 202, 347/204, 205, 208; 219/216; 428/698; 501/97.1; 427/36; 29/611, 610.1; 338/306, 308

[56] References Cited

U.S. PATENT DOCUMENTS 4,705,697 11/1987 Nishiguchi et al. ..... 427/36
4,772,520 9/1988 Takeno et al. ..... 428/698
4,777,583 10/1988 Minami et al. ..... 347/208
4,845,339 7/1989 Kato ..... 219/216
5,473,357 12/1995 Shirkawa et al. ..... 347/202
5,756,411 5/1998 Nakahata et al. ..... 501/97.1

FOREIGN PATENT DOCUMENTS 4-326052 11/1992 Japan .
5-131666 5/1993 Japan .

OTHER PUBLICATIONS

Form PCT/ISA/210 for PCT/JP95/01818, Sep. 13, 1995.

*Primary Examiner*—N. Le
*Assistant Examiner*—Anh T. N. Vo
*Attorney, Agent, or Firm*—Finnegan, Henderson, Farabow, Garrett & Dunner, L.L.P.

[57] ABSTRACT

A thermal print head is provided with a supporting substrate, a glaze layer formed on the substrate, a heating resistor which is formed on the glaze layer and made of Si and O and the rest being substantially composed of a metal, and electrodes connected to the heating resistor. The heating resistor has an unpaired electron density of $1.0\times10^{19}/cm^3$. In addition, the reaction layer formed by reaction of the glaze layer and the heating resistor is formed between the glaze layer and resistor.

21 Claims, 7 Drawing Sheets

THERMAL PRINT HEAD AND MANUFACTURING METHOD THEREOF

INDUSTRIAL FIELD OF APPLICATION

The present invention relates to a thermal print head for use in thermal printing apparatus such as a plate-making machine, a facsimile apparatus or a video printer, and a manufacturing method thereof.

BACKGROUND ART

Thermal print heads, which have advantages such as low in noise, simple in maintenance or low running costs, have been widely used in various sorts of recording apparatuses including printers for use in facsimile apparatuses and word processors. In particular, thermal print heads providing high definition of more than about 400 dpi (dots per inch) have been used for stencil printing.

Among various thermal print heads, the ones which are for use in facsimile machines and word processor printers have been strongly demanded to have a finer heating resistor and an increased input energy density for the purpose of improving their resolution. Therefore, these thermal print heads are required to meet such a demand.

In order to satisfy the demand, the thermal print head is first required to have a heating resistor of a high resistive value.

As the materials of the heating resistor, cermet system resistors are widely used. Typical cermet systems are Ta—Si—O and Nb—Si—O. These materials are formed, for example, as a sputter film with use of a sputtering target prepared by mixing Ta and $SiO_2$ powder and sintering thereof. At this time, a film having a resistivity of several mΩ to several tens mΩ can be formed while the amount of $SiO_2$, sputtering pressure, etc. is controlled.

Meanwhile, for the purpose of obtaining a heating resistor having a high resistive value, there is a method of devising the design of the heating resistor. In the case of the thermal print head, however, it is desirable to make the sheet resistance of the sputter film high per se. To this end, it is considered to make the film thin to thereby have a high sheet resistance. However, making the film thickness small leads to a short life problem with the thermal print head. For the above reason, it is desirable that the film has a high resistivity.

Secondly, it is necessary for the resistive value of the heating resistor to fluctuate less when the heating resistor is used as a thermal print head or during the manufacture of the head on an assembly line.

A Ta—Si—O film has an excellent feature as a heating resistor, but tends to be influenced by its film forming conditions. Accordingly, when the film has a small resistivity, the film is made thinner, which leads to its poor life characteristics. When the film has a large resistivity, on the other hand, the film is required to be thicker, thus prolonging its film forming time. This also disadvantageously results in that the number of substrate films capable of being formed per target is decreased. From these reasons, a resistivity range is usually controlled to be usually about 10 to 20 mΩ·cm for manufacturing of the film.

Even when the resistivity range of the heating resistor is limited as above, however, it has been found that, when the resistors are manufactured in the form of thermal print heads or devices, the devices have varying characteristics. This means that, even when the resistive films have an identical resistance, they may have respectively different structures.

The film structure includes, for example, the degree or range of order and various other defect sorts and densities.

It is difficult to grasp such a film structure on a quantitative basis and to strictly control it. For example, with respect to a film deposited as it is and a film deposited and subjected to a vacuum process at a temperature of 900° C., even when these films are subjected to a comparative analysis based on an X-ray diffractometry or a Raman spectroscopy, they fail to show a significant difference between them, exhibiting similarly broad amorphous patterns. For this reason, it has been difficult to realize a heating resistor having a good life characteristic and also to implement a thermal print head having a good life characteristic.

In addition to the above problem in the heating resistor, there is a further a problem that the resistive value of the thermal print head is non-uniform.

Making the heating resistor of the thermal print head finer and a correspondingly increased input energy density will entail a rise in the peak temperature of the central part of the heating resistor. Since a rise in the temperature generally causes a drop in the resistive value of the heating resistor, this requires a further increase in the input energy density, which further increases the temperature of the heating resistor, and further decreases the resistive value of the heating resistor. This process is repeated until the heating resistor eventually destroyed. Even when the increased temperature does not lead to its destruction, the decrease in the resistive value within the head or between the heads is not always uniform. A different decrease in the resistive value by the degree of the heating temperature results in irregularity in the printing density and quality determined.

The cause of the irregular drop in the resistive value is an insufficient thermal stability of the heating resistor and, in other words, the structural relaxation of the heating resistor is insufficient. As the thermal stabilizing measure, there is considered 1) a method for heating the heating resistor through its electrical conduction after assembling the heating resistor into a thermal print head, 2) a method for subjecting the heating resistor to a thermal process during or after the formation of the heating resistor, 3) a method for subjecting the heating resistor to irradiation of a high energy beam, 4) a method for subjecting the heating resistor to an induction heating process, or a similar method.

The measure 1) for thermally stabilizing the heating resistor is limited to its thermal stabilization level by IC rating and a reaction between the heating resistor and an electrode or protective film. For example, the thermal stabilization level is sufficient for the thermal print head for use in a facsimile equipment application but can be insufficient for use in plate making. The thermal stabilization measure 3) presents a problem from the viewpoint of its cost and productivity. The measure 4) is still in its experimental stage.

The thermal stabilization measure 2), which can thermally process the heating resistor without the problems associated with the IC and also the protective or electrode film, can set its thermal process temperature in a relatively wide range when compared to method 1), can be an excellent means from a comprehensive point of view, and can be partly put to practical use even in thermal print heads for use in plate making machines.

Conventionally, the thermal processing temperature has been mainly based on the temperature of the heating resistor at the time of driving the thermal print head as a rule of thumb. But in the case of a high-definition thermal print head for example, the temperature of the heating resistor was 800° C. as its maximum, and the thermal process temperature was higher than the temperature of the heating resistor at the time of driving the thermal print head.

As, as already mentioned above, as the requirement of a finer heating resistor and larger input energy density increases, it is necessary to have a thermal print head to be driven at high temperature, and the thermal print head characteristics, process adaptability, etc. become different to a large extent depending on the type of glazing technology. Thus, even in the thermal stabilization measure 2) for performing thermal process at a temperature higher than the temperature of the heating resistor at the time of driving the thermal print head, there occurred problems which follow.

a) There are a wide range of variations in the resistive value of the heating resistor, b) Upon manufacturing of the thermal print head, etching characteristics become deteriorated in a resistor film etching step.

c) The surface roughness of a glaze layer becomes bigger.

d) The anti-pulse life characteristic of the thermal print head deteriorates.

When these disadvantages become increased in number, it also becomes disadvantageously impossible to manufacture the thermal print head.

As also mentioned above, the finer patterning of the heating resistor of the thermal print head and the correspondingly increased input energy density entail the increase of the peak temperature of the central part of the heating resistor. As a result, when the structure of the heating resistor is fully relaxed, diffusing invasion of glaze layer components such as oxygen into the heating resistor increased. Thus, the heating resistor gradually increases in its resistive value and eventually becomes unusable. Further, when the heating resistor is driven under such conditions that the heating temperature becomes high, the resistive value of the heating resistor abruptly increases, whereby the thermal stress caused by a printing pulse may cause the heating part of the heating resistor to be released from the glaze layer. In this way, the rise of the heating temperature of the heating resistor causes not only the heating resistor to be chemically deteriorated but also mechanical destruction deteriorated, which can end in.

With respect to the aforementioned diffusing invasion of the glaze layer components into the heating resistor, such measures as will be mentioned below were considered.

(1) A barrier layer made of SiON or the like is provided between the glaze layer and heating resistor.

(2) There is employed a glazing material which is high in its thermochemistrical stability, i.e., high in its glass transition point.

(3) The layer of the heating resistor is made thick. That is, a relative length for the diffusing invasion length of glaze component grown during operation of the thermal print head is made short.

The above measure (1) presents a problem from the viewpoints of its productivity, cost and yield and thus impractical. The measure (2) is insufficient for the aforementioned demand because the glass transition point of 800° C. becomes its technical upper limit from the viewpoint of maintaining the smoothness of the glaze. In the measure (3), when the layer thickness is simply increased, the resistive value drops. When, as the resistivity of the heating resistor layer is made high, it becomes difficult to obtain controllability over the resistive value and to manufacture a sputter target. When it is tried to cope with it by modifying the shape of the heating resistor layer, it becomes difficult to accurately perform patterning operation.

As mentioned above, any of the aforementioned measures has its own problems and cannot be a practical measure against the problem of the diffusing invasion of the glaze component into the heating resistor. Further, with regard to the problem of the heating part of the heating resistor being released from the glaze layer, no specific measure has been devised.

DISCLOSURE OF INVENTION

The present invention has been provided to solve the aforementioned problems, and it is therefore a first object of the present invention to provide a thermal print head which has a good life characteristic.

A second object of the present invention is to provide a thermal print head which has a heating resistor with a less-fluctuating resistive value and has a glaze layer having a flat surface, and also which is excellent in its anti-pulse characteristics.

A third object of the invention is to provide a method for manufacturing a thermal print head which has excellent anti-pulse characteristics by suppressing fluctuations in the resistive value of the heating resistor and by suppressing the surface roughness of a glaze layer.

A heating resistor for use in a thermal print head in accordance with the present invention is made of a cerment material containing Si, O and a metal, wherein the resistor has an unpaired electron density of $1.0\times10^{19}$ spins/cm$^3$ or less.

The present invention is further featured in that the metal is at least one selected from a group consisting of Ta, Nb, Cr, Ti, W, and V, and the resistor has an unpaired electron density of $1.0\times10^{18}$ spins/cm$^3$ or less.

A first thermal print head in accordance with the present invention comprises a supporting substrate, a heating resistor formed on the supporting substrate and made of a cerment material containing Si, O and a metal, and an electrode formed on the heating resistor, wherein the heating resistor has an unpaired electron density of $1.0\times10^{19}$ spins/cm$^3$ or less.

Further the first thermal print head in accordance with the present invention is characterized in that the metal is at least one selected from a group consisting of Ta, Nb, Cr, Ti, W, and V, and the resistor has an unpaired electron density of $1.0\times10^{18}$ spins/cm$^3$ or less.

Furthermore, the first thermal print head in accordance with the present invention may also have arrangements which follow. That is, a thermal print head comprises a supporting substrate, a glaze layer formed on the supporting substrate, a heating resistor formed on the glaze layer and made of a cerment material containing Si, O and a metal and an electrode formed on the heating resistor; wherein the heating resistor has an unpaired electron density of $1.0\times10^{19}$ spins/cm$^3$ or less.

The heating resistor is characterized in that the metal is at least one selected from a group consisting of Ta, Nb, Cr, Ti, W, and V in balance, and that the resistor has an unpaired electron density of $1.0\times10^{18}$ spins/cm$^3$ or less.

A second thermal print head in accordance with the present invention comprises a supporting substrate, a glaze layer formed on the supporting substrate, a heating resistor formed on the glaze layer and made of a cermet material containing Si and O and a metal, and an electrode formed on the heating resistor; the supporting substrate having the glaze layer and heating resistor thereon is heat-treated at a temperature of not less than a glass transition point of the glaze layer and not more than a softening point thereof.

Further the second thermal print head comprises a supporting substrate, a glaze layer formed on the supporting substrate, a heating resistor formed on the glaze layer, and an electrode formed on the heating resistor, wherein the heating resistor is operated at a temperature not less than the glass transition point of the glaze layer at the time of driving the heating resistor; and wherein the supporting substrate having the glaze layer and heating resistor thereon is heat treated at a temperature of not less than a glass transition point of the glaze layer and not more than a softening point thereof.

Further, the second thermal print head is characterized in that the supporting substrate having the glaze layer and heating resistor thereon is heat-treated at a temperature of not less than a yield point of the glaze layer and not more than the softening point thereof.

A third thermal print head in accordance with the present invention comprises a supporting substrate, a glaze layer formed on the supporting substrate, a heating resistor formed on the glaze layer, and an electrode formed on to the heating resistor; and an interfacial mixing a reaction layer is formed between the glaze layer and the heating resistor.

Further, the third thermal print head is characterized in that the heating resistor is made of a cermet material selected from the group consisting of a first material consisting essentially of of Ta, Si and a second material consisting essentially of O and Ta, Si, O and C.

Furthermore, the third thermal print head is characterized in that an oxygen content in the heating resistor is in a range of 40 to 70 atomic %, an oxygen content in the glaze layer is in a range of 50 to 80 atomic %, and an oxygen content in the reaction layer continuously decreases from a surface contacted with the glaze layer to another surface contacted with the heating resistor.

In addition, the third thermal print head in accordance with the present invention is characterized in that a thickness of the reaction layer is in a range of 1/30 to 1/3 of a thickness of the heating resistor.

A method for manufacturing a thermal print head in accordance with the present invention comprises the steps of forming a heating resistor on a glaze layer formed one major surface of a supporting substrate, and heat-treating the heating resistor at a temperature in range from a glass transition point of the glaze layer to a softening point thereof.

Further, the method for manufacturing a thermal print head is characterized in that, in the heat-treating the heat-treating is carried out at a temperature of not less than a yield point of the glaze layer and not more than the softening point thereof.

A thermal print head of the present invention will be further explained in detail in the following.

With respect to a resistor and first thermal print head in accordance with the present invention, the heating resistor forming the thermal print head is made of Si, O and substantially a metal in balance and has an unpaired electron density of $1.0\times10^{19}$ spins/cm$^3$ or less.

The unpaired electron density is defined as a spin density in the resistive film measured based on the electron spin resonance.

The present inventor has found that the spin density of the resistive film measured based on the electron spin resonance has a strong relationship with the stability of the resistive value and that reproducibility is excellent in the stable resistive value so long as the spin density is in a constant range.

And in the case where the heating resistor in the thermal print head is made of Si, O and substantially a metal in balance, it has been confirmed that, when the unpaired electron density exceeds $1.0\times10^{19}$ spins/cm$^3$, the resistive value becomes unstable, which results in that the variation of the resistive value in the manufacturing steps becomes unstable, a yield is reduced, and the life characteristics of the product are deteriorated.

It has also been confirmed, in the case where the metal balance, other than Si and O, in the heating resistor is Ta or Nb, that, when the heating resistor has an unpaired electron density of $1.0\times10^{18}$ spins/cm$^3$ or less, the heating resistor is stable in the resistive value.

Also, the spin density measured based on the electron spin resonance, i.e., the unpaired electron density is considered to reflect the defect density of the film, typically, a dangling bond density.

In general, an electron spin resonance spectrum can be observed when any unpaired electron is present in a sample. The unpaired electron appears due to the defects (more concretely, a vacancy meaning a state in which an atom is not located at its original lattice site) in the sample, though it is also considered to appear due to typical conduction electrons, donors and acceptors. For this reason, a variation in the resistive value during operation of the device is divided into two modes, which are both estimated to be associated with vacancies in the resistive film.

One of the two modes corresponds to when the resistive value increases. This mode occurs when glaze components, typically oxygen (O), are diffusedly introduced into the resistive film to oxidize the resistive film. In general, diffusion a coefficient exponentially increases with temperature. Accordingly, this means that, with respect to the resistive film having a large vacancy density (i.e., a large unpaired electron density), the diffusion coefficient of the glaze component becomes large and thus the glaze component easily diffuses into the resistive film.

The other mode corresponds to when the resistive value decreases. This mode takes place when conduction carrier mobility increases. With respect to the resistive film having a large vacancy density, potential energy is high and the film is in its unstable state, as a matter of course. More vacancies cause conduction carriers to be captured by the vacancies, whereby electron wave tends to be easily disturbed and resistivity is high. However, supply of thermal energy causes lattice vibration to be strong and the system proceeds in such a direction that these vacancies are filled, i.e., that the system is put in its stable state, thus increasing the conduction carrier mobility. This corresponds to annealing action.

In the first thermal print head of the present invention, when the unpaired electron density of the heating resistor film is limited to a definite range or less, the resistive value can be made reliably stable.

The second thermal print head of the present invention comprises a supporting substrate, a glaze layer formed on the heating resistor, a heating resistor formed on the glaze layer, and an electrode connected to the heating resistor; and is characterized in that the supporting substrate having the glaze layer and heating resistor thereon is subjected to a thermal process (heat-treatment) in a range from the glass transition point of the glaze layer to the softening point thereof.

The softening point of the glaze layer refers to a temperature at which, when the glaze made of a fiber having a diameter of 0.55 to 0.75 mm and a length of 235 mm is heated at an increasing rate of 4 to 6° C./min., the elongation of the fiber reaches 1 mm/min. In general, the viscosity of the fiber at the softening point is about $10^{6.6}$ Pa·S.

The glass transition point of the glaze layer, which is also called the annealing point, is a temperature at which the elongation speed reaches 0.135 mm/min. when a load of 1 kg is applied to the glaze made up of a fiber having a diameter of 0.55 to 0.75 mm and a length of 460 mm, and the fiber is heated to a high temperature not exceeding 25° C. beyond the glass transition point (which temperature is eventually required), and then cooled at a cooling rate of 4 to 6° C./min. In general, the viscosity of the fiber at the glass transition point is about $10^{12}$ Pa·S.

The second thermal print head of the present invention is further characterized in that the supporting substrate having the glaze layer and heating resistor thereon is subjected to a temperature of not less than the yield point of the glaze layer and not more than the softening point thereof. The yield point of the glaze layer as used herein, which is also referred to as sag point, refers to a temperature with which the fiber of the so-called glaze in the glaze layer having a diameter of 0.55 to 0.75 mm starts its sagging by its own weight. This temperature is determined by a beam bending method. The viscosity of the fiber at the yield point is about $10^{12}$ Pa·S, which that is located intermediate of the glass transition point and softening point.

In the case of the second thermal print head of the present invention, when it is desired that the glaze layer and heating resistor formed on the supporting substrate be simultaneously subjected to a thermal process, the thermal process at a temperature exceeding the softening point of the glaze causes excessive solid-phase reaction between the glaze layer and heating resistor, which causes poor results.

The diffusion coefficient during the solid-phase reaction exponentially increases with temperature. In any thermal process apparatus, it is impossible to remove temperature distribution completely. Thus, at such a high temperature, a slight temperature difference causes a large diffusion coefficient difference, thus incurring a large variation in the resistive value. The heating resistor that underwent the solid-phase reaction on the glaze deteriorates and loses the adaptability to the original resistor etching step, whereby etching becomes hard. When the temperature exceeds the softening point, the glaze starts to exhibit its fluidity and its initial shape starts to collapse. This is followed by the fact that the surface roughness is extremely increased and the initial, important smoothness of the glaze is lost. With use of the combination of such deteriorated heating resistor and glaze, not only it is impossible to obtain a desired anti-pulse life characteristic but also the manufacturing itself of the thermal print head becomes substantially impossible.

When the thermal process is carried out at a temperature lower than the glass transition point of the glaze, the anti-pulse life characteristic drops as the thermal process temperature departs from the glass transition point of the glaze. This results from the fact that the thermal stability of the heating resistor and glaze, and more specifically the structural relaxation, is insufficient. Variation in the resistive value within the substrate presents no problem, but variation increase in the resistive values between the substrates after the thermal process. This is because, in a thermal process temperature dependency characteristic of the resistance change rate between before and after the thermal process, the differential coefficient of the characteristic becomes relatively large in a thermal process temperature zone lower than the glass transition point.

From the above consideration, it has been found that, when the glaze layer and heating resistor are simultaneously subjected to the thermal process at a temperature of not less than the glass transition point of the glaze layer and not more than the softening point thereof, there can be obtained a stable thermal print head which is excellent in its anti-pulse life characteristic and high in its yield.

This is effective especially for such a thermal print head in which the heating resistor temperature in its driven mode is the glass transition point or more of the glaze layer, that has been conventionally difficult to manufacture and to obtain desired device characteristics.

In the second thermal print head of the present invention, further, the thermal process temperature is limited to a level of not less than the yield point of the glaze layer and not more than the softening point thereof. Such limitation of the thermal process temperature range enables manufacturing of a thermal print head which has a more excellent anti-pulse life characteristic.

In the second thermal print head of the present invention, even when an insulating film of inorganic material such as $SiO_2$ is formed between the glaze layer and resistor, the thermal process can produce similarly advantageous effects under the same temperature conditions as in the above.

In the second thermal print head of the present invention, it is preferable that the heating resistor have a thickness of 0.1 $\mu$m or less and more preferably, 0.05 to 0.1 $\mu$m.

In the second thermal print head of the present invention, further, the heating resistor can be made of cermet material such as Ta—Si—O, Nb—Si—O or Cr—Si—O.

The third thermal print head of the present invention comprises a supporting substrate, a glaze layer formed on the supporting substrate, a heating resistor formed on the glaze layer, and an electrode connected to the heating resistor; and is characterized in that a reaction layer for both of the glaze layer and heating resistor is formed between the glaze layer and heating resistor.

The heating resistor used in the thermal print head of the present invention may be made of cermet material such as, e.g., Ta—Si—O, Ta—Si—C—O or Nb—Si—O as its major components.

The glaze layer is made of $SiO_2$, SrO and $Al_2O_3$ as its main materials as well as $La_2O_3$, BaO, $Y_2O_3$ and CaO as other added materials.

In this case, an oxygen content in the heating resistor is in a range of 40 to 70 atomic %, an oxygen content in the glaze layer is in a range of 50 to 80 atomic %, an oxygen content in the reaction layer is in a range of 40 to 80 atomic %, and a distribution of the oxygen content of the reaction layer varies with a gradient continuously changed from the heating resistor to the glaze layer. A thickness of the reaction layer is in a range of 1/30 to 1/3 of a thickness of the heating resistor.

The provision of the reaction layer, i.e., interfacial mixing layer between the heating resistor and glaze layer, refers to the fact that the boundary between the heating resistor and glaze layer becomes dull, which means that the mutual energy between the heating resistor and glaze layer to be considered as a van der Waals energy approaches to usual solid aggregation energy, that is, an increase in adhesion energy. In this way, the adhesion between the heating resistor and glaze layer is remarkably improved and thus it becomes hard for such release between layers resulting from the thermal cycle stress based on applied pulses as mentioned above to take place.

The reaction layer also has a function of suppressing diffusing intrusion of the glaze component into the heating resistor layer caused by the pulse application. The solid-phase reaction is generally expressed by a Fick's diffusion equation which follows.

$J=-D(dn/dx)$, where J denotes diffusion rate, D denotes diffusion coefficient, and (dn/dx) denotes concentration gradient.

That is, the diffusion rate J is determined by a product of the diffusion coefficient D and concentration gradient (dn/dx). Since the intervention of the reaction layer causes the concentration gradient of each component element of the heating resistor and glaze layer to be decreased, delay of the diffusion rate can be derived.

In other words, the slower the concentration gradient is the slower the diffusion rate.

When such a layer as to have a low O (oxygen)—concentration gradient from the glaze layer to the heating resistor layer is present as in the reaction layer of the present invention, this can suppress diffusing intrusion of the glaze layer component into the heating resistor layer caused by the pulse application and also can suppress the increase of the resistive value of the heating resistor caused by the diffusing introduction.

In the third thermal print head of the present invention, the oxygen content in the heating resistor is preferably 40 to 70 atomic %. When the oxygen content is less than 40 atomic %, the resistivity of the heating resistor becomes too low and this inevitably requires the film thickness to be made thin, which results in that control of the resistive value becomes difficult and also the resultant thermal print head is deteriorated in its life characteristic. When the oxygen content exceeds 70 atomic %, it becomes difficult to manufacture its sputter target or perform control over the resistive value. The oxygen content is preferably 50 to 60 atomic %.

When the oxygen content of the glaze layer is less than 50 atomic % or when the oxygen content exceeds 80 atomic %, it becomes hard to maintain the basic structure of the glass made of $SiO_2$. The oxygen content is more preferably 50 to 70 atomic %.

When the thickness of the reaction layer is less than 1/30 of the thickness of the heating resistor layer, the reaction layer cannot sufficiently perform its function as a barrier layer between the glaze layer and heating resistor layer, and also cannot sufficiently perform its function as an adhesion layer between the both layers. When the thickness of the reaction layer exceeds 1/3 of the thickness of the heating resistor layer, this entails disadvantages that variation in the resistive value increases and the surface smoothness of the heating resistor layer is lost.

In the third thermal print head of the present invention, the reaction layer is made, for example, by forming the heating resistor layer on the glaze layer by the sputtering process and then by subjecting the resultant layers to the thermal process in a vacuum. The heating temperature is required to be set in a temperature range of not less than the glass transition point of the glaze layer and not more than the softening point thereof, and preferably in a temperature range between the glass transition point and the glass transition point plus 50° C.

DETAILED DESCRIPTION OF THE INVENTION

An embodiment of a thermal print head in accordance with the present invention will be explained with reference to examples.

EXAMPLE 1:

To measure an unpaired electron density by an electron spin resonance measurement means based on electron spin resonance of a heating resistor layer in a first thermal print head of the present invention, samples were prepared in the following manner.

A quartz plate was used as a supporting substrate. The quartz plate was used because the use of a supporting substrate for a thermal print head such as a glazed alumina substrate causes an electron spin resonance spectrum based on the substrate itself to be overlapped with an electron spin resonance spectrum based on a resistive layer, thereby making it difficult to analyze it.

Next, the quartz plate was subjected to an RF sputtering process to form a Ta—Si—O film.

In this case, a sintered body of mixture of Ta and $SiO_2$ was used as a target. And the quartz plate having the Ta—Si—O film formed thereon was used as an sample and then subjected to an electron spin resonance measurement.

The measuring conditions were a magnetic-field sweeping range of 335.500±5.0 mT, modulation of 100 kHz–0.1 mT, microwave of 2 mW, a sweeping time of 5 sec.×100 repetitions, a time constant of 0.01 sec., a reference sample of weak-coal (spin=$1.74\times10^{14}$). The measurement was carried out at room temperature.

Figure 1:
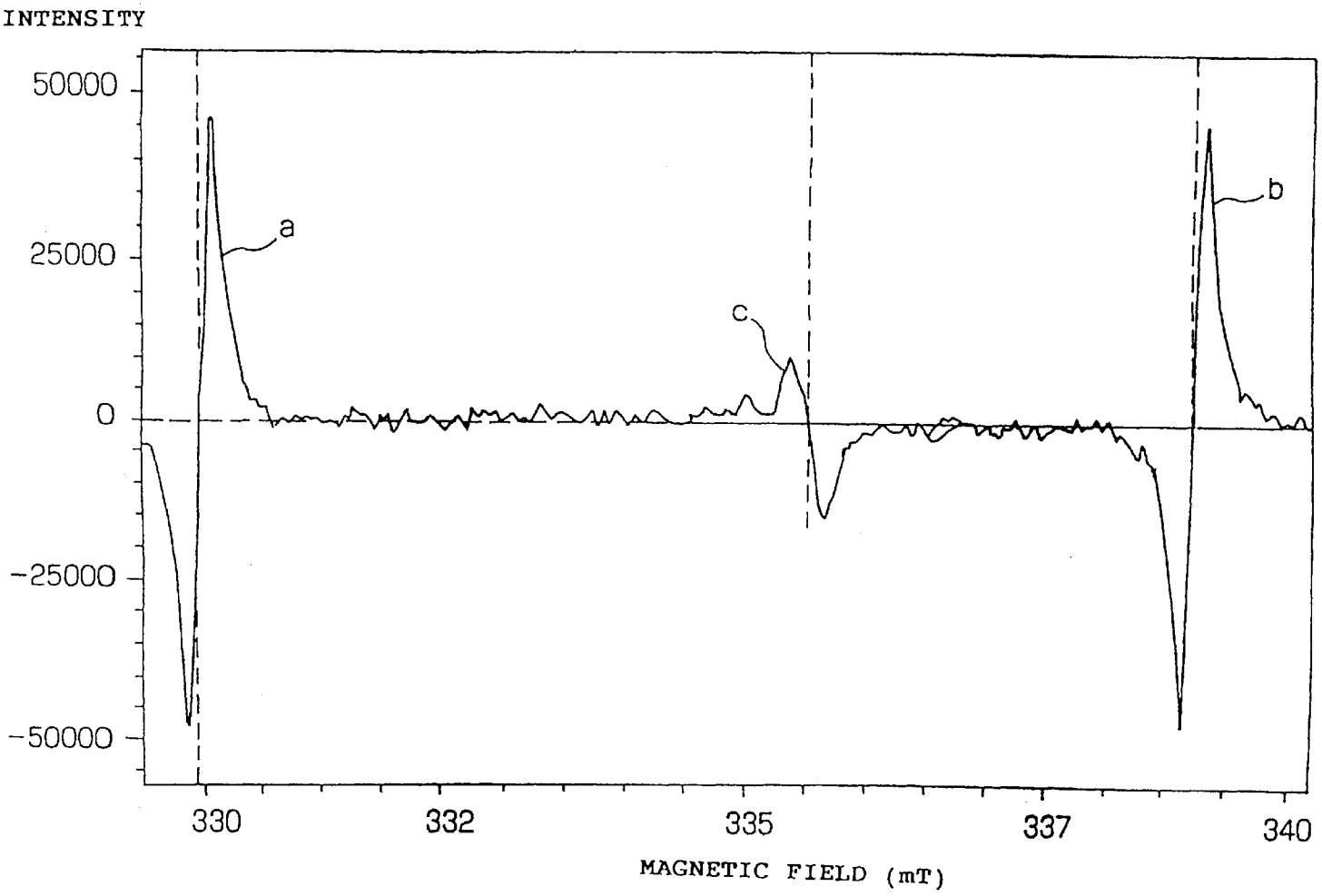
FIG. 1 shows an electron spin resonance spectrum for a heating resistor film used in forming a thermal print head in accordance with an embodiment of the present invention.

The target was made in the form of a sintered body made of 47 mol % of Ta and 53 mol % of $SiO_2$, film formation was carried out under conditions of an RF power of 3.3 W/cm$^2$ to the target and an Ar pressure of 1.0 Pa, and subsequently the sample was subjected to an annealing process for 15 minutes under a vacuum condition at a temperature of 700° C. to have a resistivity value of 11.0 mΩ·cm. The electron spin resonance spectrum of the resultant sample is shown in FIG. 1. Peaks indicate the presence of unpaired electron density. In the drawing, abscissa denotes magnetic field, ordinate denotes strength, absorption spectra a and b appearing in the vicinity of 330 or 339 mT result from the quartz plate, and absorption spectrum c appearing in the vicinity of a magnetic field of 336 mT results from the resistive film. A spin density for the resistive film calculated on the basis of the strength of the absorption spectrum was $2.0\times10^{17}$ spins/cm$^3$.

Similarly, comparative samples were made. That is, a target was made in the form of a sintered body made of 49 mol % of Ta and 51 mol % of $SiO_2$, film formation was carried out under conditions of an RF power of 3.3 W/cm$^2$ to the target and an Ar pressure of 1.0 Pa. Subsequently, the sample was not subjected to any thermal process to have a resistivity of 11.0 mΩ·cm and then was subjected to an electron spin resonance measurement. At this time, a spin density for the resistance film was $3.5\times10^{18}$/cm$^3$.

Next with use of the resistive films formed under the above conditions, thermal print heads were prepared respectively. In this example, an alumina substrate subjected to a glaze process was used as the substrates. Heating resistor films were formed on said alumina substrates respectively in such a manner as mentioned above. A sample A having a spin density of $2.0\times10^{17}$/cm$^3$ and a sample B having a spin density of $3.5\times10^{18}$/cm$^3$ were made.

Thereafter, individual electrodes and common electrodes made of Al were formed on the heating resistor and subjected to a predetermined patterning process, and further a heating part enclosed by the individual or common electrodes was covered with a protective layer made of Si—O—N and then actually mounted to thereby obtain a thermal print head for use in a plate-making machine, with the resistor having dimensions 60×35 μm and a resolution of 400 dots/inch.

Figure 2:
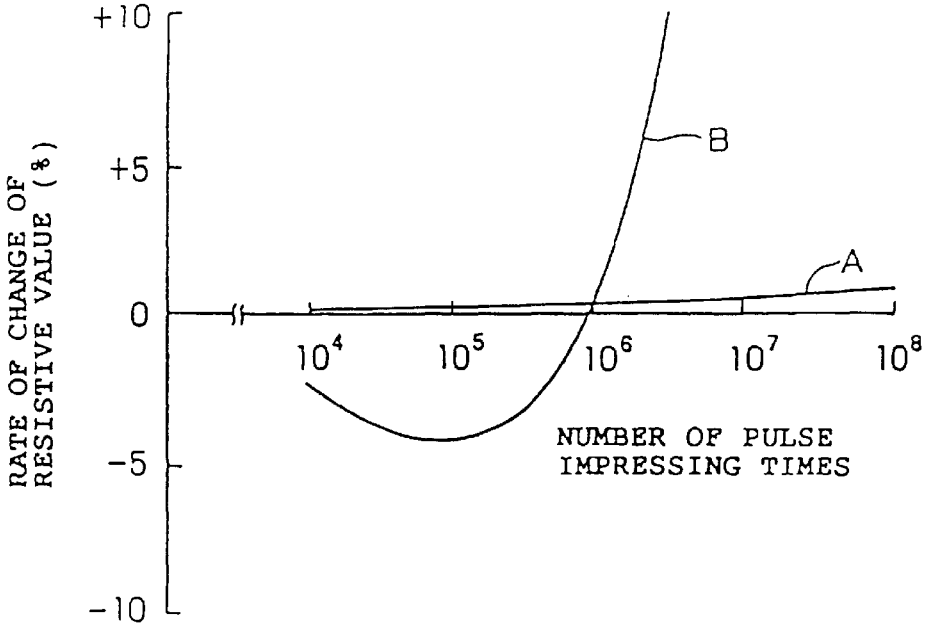
FIG. 2 shows experimental results of anti-pulse life of the thermal print head in accordance with the present invention.

And the samples A and B were subjected to an anti-pulse life test. For example, the samples were continually supplied with pulses under driving conditions of a power of 0.28 W/dot and a pulse width of 0.5 msec. and a pulse period of 3.0 msec. and were subjected to an evaluation of a rate of change of resistive value. The results are given in FIG. 2. In the drawing, ordinate denotes a rate of change in resistive value (%) and abscissa denotes the number of pulse impressing times (cycles).

With respect to the sample B in the comparative example, the resistive value drops during the pulse impression from 0 to $1\times10^5$ cycles, and thereafter, rises and exceeds a change rate of +10% at the time of pulse impression of $2\times10^6$ cycles.

With respect to the sample A in the example, on the other hand, it has been observed that the resistive value tends to monotonously increase from the beginning. However, the resistive value was stable and a change rate was +1.5% even after the pulse impression of $1\times10^8$ cycles.

Further, when a resistive film having the same spin density was formed under changed film formation conditions, similar characteristics were obtained.

Figure 3:
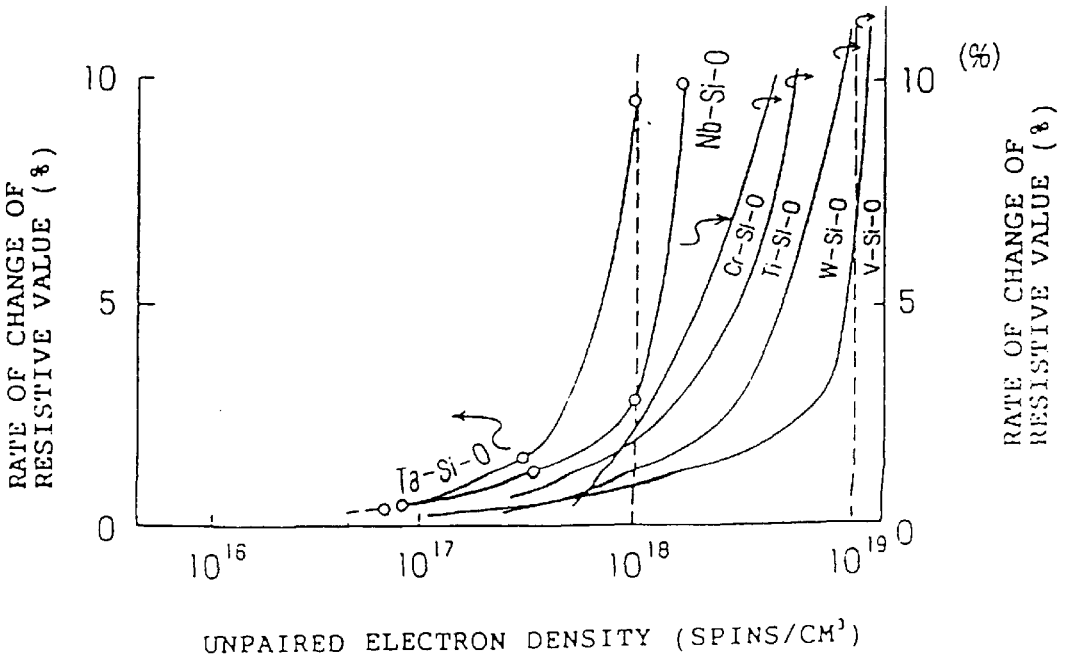
FIG. 3 is a diagram for explaining a relationship between an unpaired electron density of a heating resistor thermal print head layer and a rate of change of resistance value in anti-pulse life experiments in the thermal print head of the present invention.

EXAMPLE 2:

Heating resistor films made of Ta—Si—O, Nb—Si—O, Cr—Si—O, Ti—Si—O, W—Si—O and V—Si—O were examined with respect to a relationship between the unpaired electron density of the films and the life characteristic of thermal print heads. These resistive films were prepared substantially in the same manner as in the Example 1. The results are given in FIG. 3. In the drawing, abscissa denotes the unpaired electron density of the heating resistor films, and ordinate denotes a rate of change of resistance at the time of the pulse impression of $1\times10^8$ cycles in an anti-pulse life test conducted under the same conditions as in the Example 1.

As illustrated, as the unpaired electron density is increased, the rate of change of resistive value exponentially varies, and when the unpaired electron density exceeds $1.0\times10^{18}$ spins/cm$^3$, the rate of change of resistive value exceeds 10% in the case of the Ta—Si—O. In the case of the Nb—Si—O, the rate of change of resistive value was by an order of magnitude larger than that in the case of the Ta—Si—O and was as large as about 30% already at the time of $1.0\times10^{18}$ spins/cm$^3$. With respect to any of the Cr—Si—O, Ti—Si—O, W—Si—O and V—Si—O, the rate of change of resistive value increases abruptly when the unpaired electron density exceeds $1.0\times10^{18}$ spins/cm$^3$. The rate of change of resistive value was an order of magnitude larger than that in the case of the Ta—Si—O. In any case, any of the samples was observed to have a large rate of change of resistive value when the unpaired electron density exceeds $1.0\times10^{19}$ spins/cm$^3$.

EXAMPLE 3:

Sixty thermal print heads corresponding to the samples A and B shown in the Example 1 was prepared and fed on a flow line in the same lot. A correlation was examined between an average of sheet resistances after formation of the resistive film all over the substrate, i.e., before formation of the Al electrode film, and an average of resistances of resultant products after formation of the thermal print heads.

As a result, a correlation coefficient was 0.98 for the sample A, and was 0.73 for the sample B. When it is considered from the result to set a specification for the sheet resistive value, for example, when a thermal print head is to be set to have a fluctuation specification of ±10% for the product resistive value, the sample A is allowed within ±7.5%, whereas the sample B is demanded to have a considerably strict specification of ±2.5%.

Figure 4:
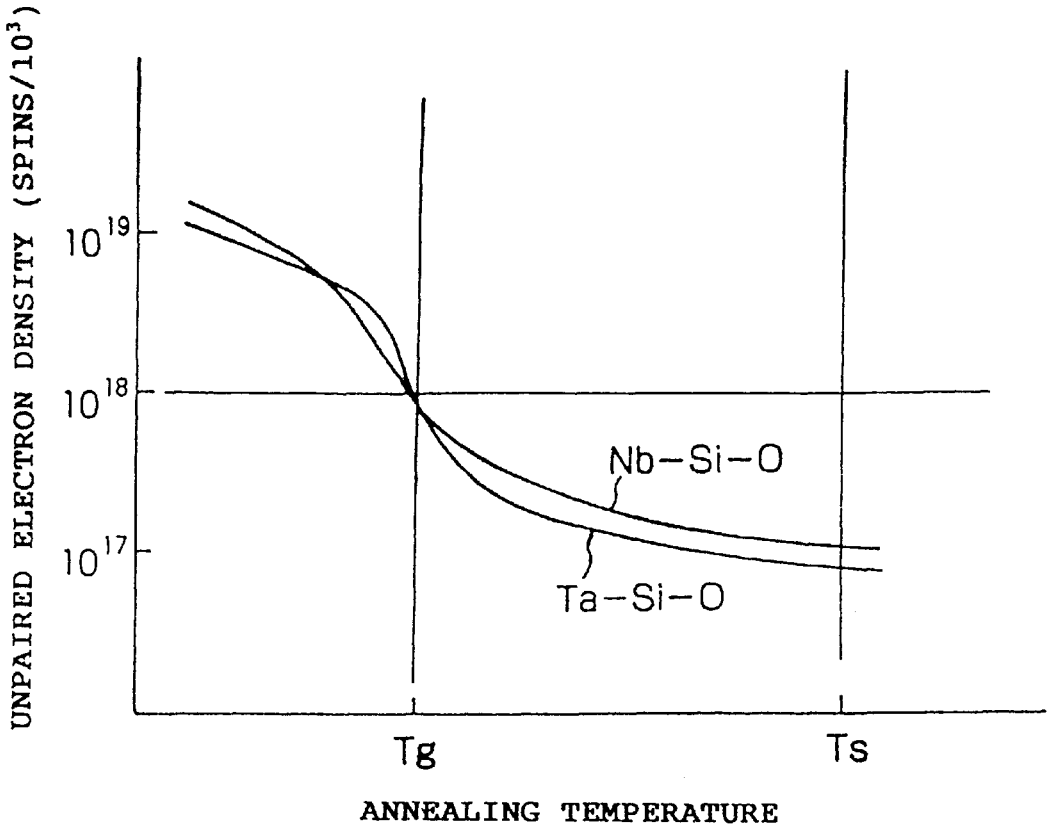
FIG. 4 shows a relationship between the unpaired electron density of the heating resistor layer and a heat process temperature (annealing temperature) thereof in the thermal print head of the present invention.

EXAMPLE 4:

With respect to the samples of the Example 2, the thermal process conditions were changed and correlations were examined between the unpaired electron density and thermal process temperature (annealing temperature). Which results are given in FIG. 4.

In any of the Ta—Si—O and Nb—Si—O, the unpaired electron density is decreased as the thermal process temperature is increased. In order for the both heating resistor films to have a preferable unpaired electron density of $1.0\times10^{18}$ spins/cm$^3$ or less, the annealing temperature is required to be equal to or higher than the glass transition point of the glaze layer, as will be seen.

As already explained in the foregoing Examples 1 to 4, when the unpaired electron density of the heating resistor film is limited, there can be obtained an excellent heating resistor which resistive value is stable. Thus there can be manufactured thermal print heads which have a long life, with good stabilization and yield according to the present invention.

Figure 5:
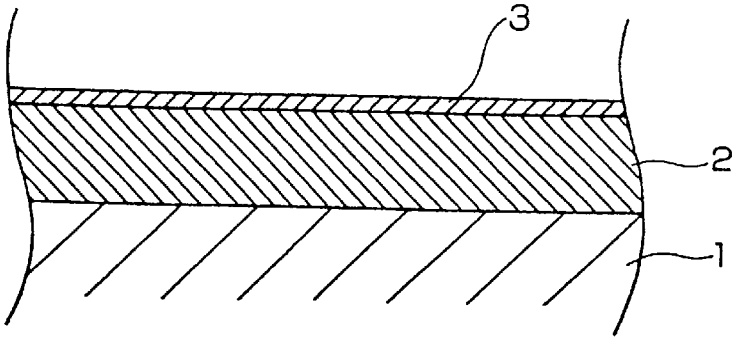
FIG. 5 shows a cross-sectional view of a major structure of the thermal print head.

EXAMPLE 5:

FIG. 5 shows a cross-sectional view of a major part of a thermal print head.

A glaze layer 2 having a thickness of 10 $\mu$m was provided as a substrate onto an alumina supporting substrate (having a size of 275×55×1.0 mm) 1 containing 97 wt % of $Al_2O_3$. The starting materials of the glaze are $SiO_2$, SrO and $Al_2O_3$ as main materials and $La_2O_3$, BaO, $Y_2O_3$ and CaO as other materials to realize compatibility between the heat resistance and smoothness. After the starting materials were melted at a temperature of 1500° C., the material was quickly cooled to form a quench glass, the quench glass was finely crushed by a ball mill, coated on the alumina supporting substrate 1, and then baked at a temperature of 1200° C. The glaze had a glass transition point of 750° C., a yield point of 800° C. and a softening point of 940° C.

Formed on the glaze by an RF sputtering process was a heating resistor layer 3 which comprises Ta—Si—O or Nb—Si—O. Targets were made in the form of a sintered mixture body made of 47 mol % of Ta and 53 mol % of $SiO_2$ and in the form of a sintered mixture body made of 47 mol % of Nb and 53 mol % of $SiO_2$; an Ar pressure was 1.1 Pa, an RF power density was 3.3 W/cm$^2$, a resistivity was 12 mΩ·cm, and a film thickness was 30 nm to 200 nm.

Thereafter, the samples of this example and the comparative example were subjected to a thermal process respectively for 15 minutes at a temperature of 400 to 1000° C.

Thermal process temperature dependencies of the respective characteristics are given in FIGS. 6 to 10.

Figure 6:
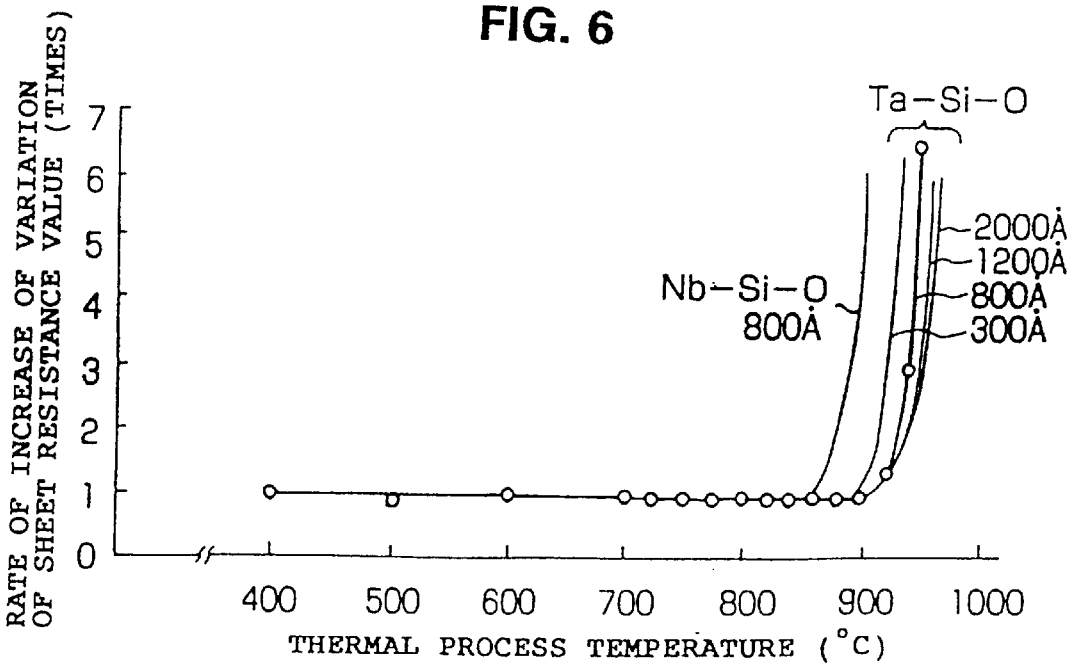
FIG. 6 shows a relationship between the thermal process temperature of a heating resistor and a rate of change in variations of a sheet resistive value based on the thermal process of the heating resistor.

FIG. 6 shows thermal process temperature dependencies on a rate increase of variation of sheet resistive values. The sheet resistive value variation increase rate is a division of a sheet resistive value variation after the thermal process by a sheet resistive value variation before the thermal process. The sheet resistive value variation was found in the following manner.

First, sheet resistive values at 15 points substantially-regularly-positioned along the center of a longitudinal direction of the substrate are measured. Next, a difference between maximum and minimum ones of the sheet resistive values of the 15 points is found and then is divided by an average of the sheet resistive values of the 15 points.

In FIG. 6, when the heating resistor is made of Ta—Si—O, the sheet resistive value variation increase rate maintains nearly 1 until 900° C., but the rate starts to increase regardless of the resistor thickness when the temperature exceeds 900° C. In particular, when the temperature exceeds the softening point of the glaze of 940° C., the sheet resistive value variation increase rate fully increases and departs from its resistive value controllable range. As a result, it becomes impossible for the resultant thermal print head to be normally used. When the heating resistor is made of Nb—Si—O, it has been found that a temperature which abruptly increases the resistivity variation is not more than 900° C.

Figure 7:
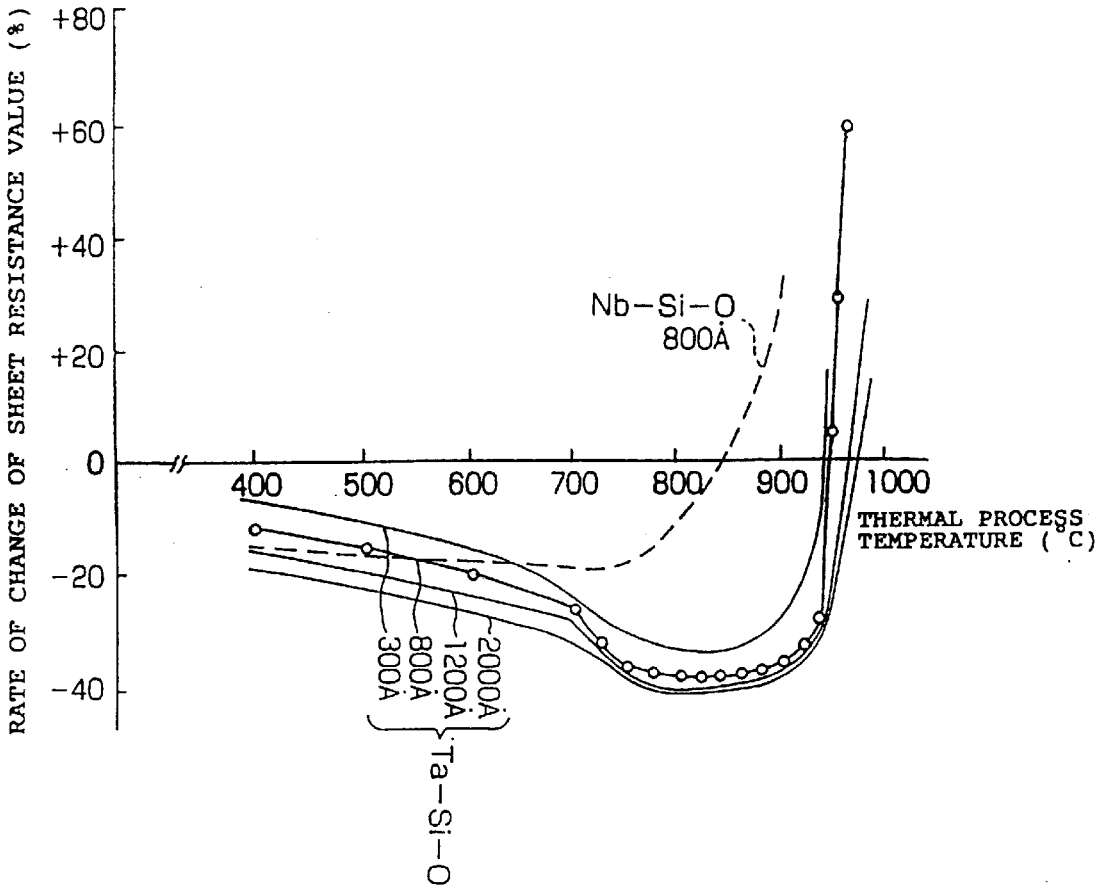
FIG. 7 shows a relationship between the thermal process temperature of a heating resistor and a rate of change in variations of a sheet resistive value based on the thermal process of the heating resistor.

FIG. 7 shows thermal process temperature dependencies of sheet resistive value change rates. The term "sheet resistive value change rate" as used therein means how an average of the aforementioned sheet resistive values of the 15 points is varied after the thermal process.

When the heating resistor is made of the Ta—Si—O, the sheet resistive value change rate monotonously decreases with a gradient of a negative value in a temperature range of 400 to 700° C., but the decrease gradient of the rate becomes larger in a temperature range of 700° C. to 750° C. at the glass transition point of the glaze. The thermal process in such a range is disadvantageous from the viewpoint of minimizing resistive value variations between substrates. The sheet resistive value change rate is as stable −36 to −38% in a temperature range of 750 to 900° C. When the temperature exceeds 900° C., the sheet resistive value change rate starts to clearly increase with a positive differential gradient. When the temperate exceeds the softening point of 940° C., the positive differential gradient extremely increases and the sheet resistive value change rate also changes to its positive value. In this range, it becomes impossible to manufacture the thermal print head.

When the heating resistor is made of Nb—Si—O, the sheet resistive value change rate will not substantially change until 750° C., though negative. When the temperature exceeds the 750° C., however, the sheet resistive value change rate becomes abruptly increases.

Figure 8:
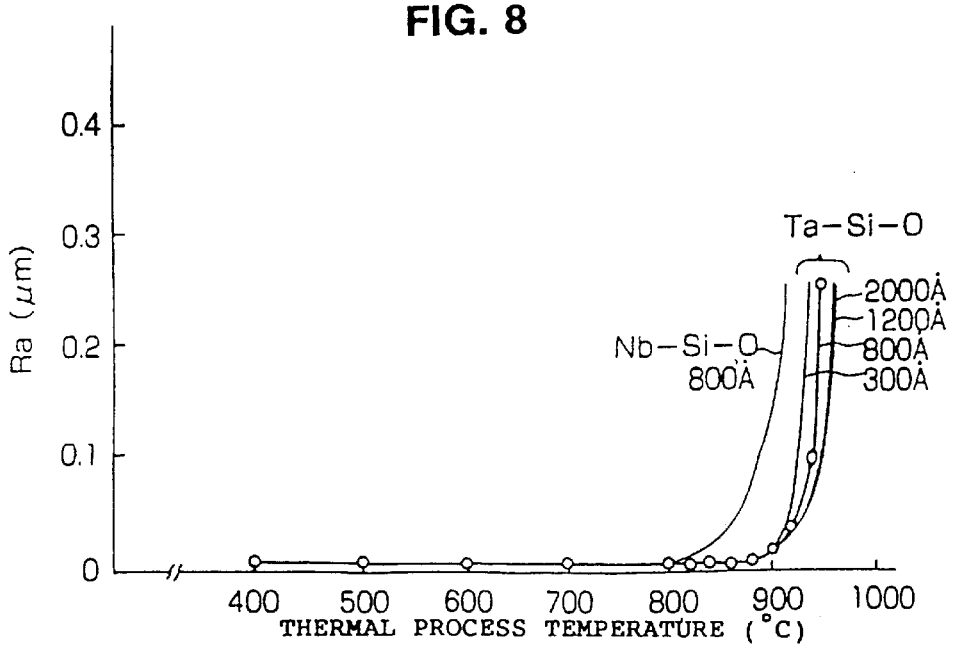
FIG. 8 shows a relationship between the thermal process temperature of the heating resistor and a surface roughness Ra (JIS) of the heating resistor.

FIG. 8 shows thermal process temperature dependencies of a surface roughness Ra of the heating resistor after the thermal process.

When the heating resistor is made of Ta—Si—O, the thermal process of the heating resistor at a temperature exceeding the softening point of the glaze of 940° C. results in that the surface roughness Ra have a value of 0.1 $\mu$m or more and thus the heating resistor cannot be used practically. It will be seen from the drawing that, in particular, the thinner the thickness of the heating resistor is the more the surface roughness Ra thereof is influenced.

When the heating resistor is made of Nb—Si—O, the surface roughness Ra gradually increases when the temperature exceeds 800° C., and the resultant heating resistor cannot be used practically even at a temperature of 900° C., lower than the softening point of the glaze of 940° C.

These samples, after formation of Al electrode layers thereto, were subjected to a photoengraving process for their patterning.

In the present process, the heating resistor was subjected to a chemical dry etching (CDE) process with use of reaction gases of $CF_4$ and $O_2$.

Figure 9:
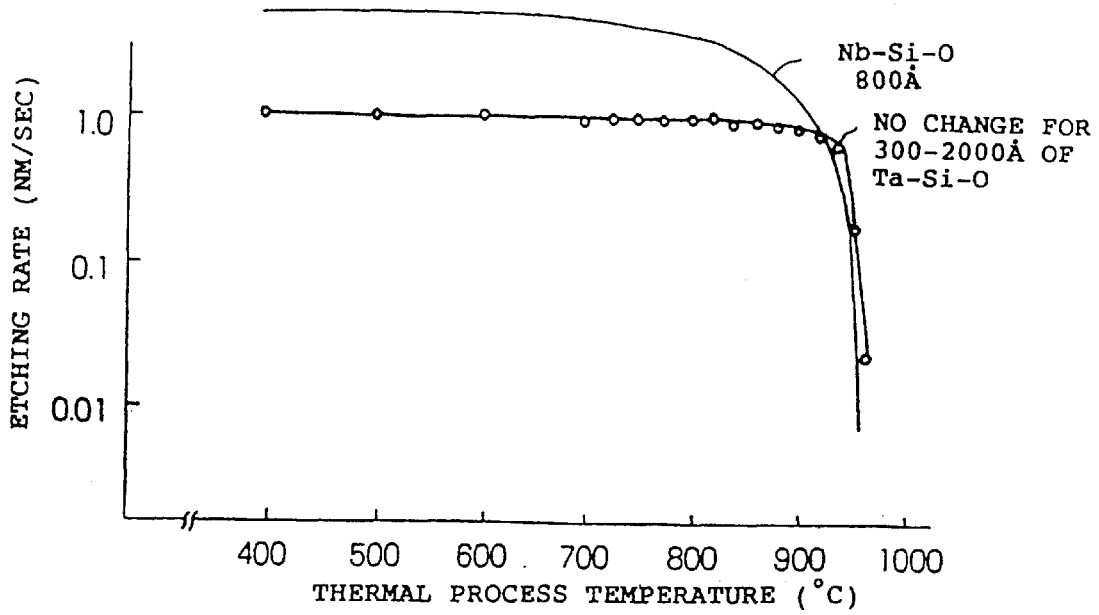
FIG. 9 shows a relationship between the thermal process temperature of the heating resistor and an etching rate of the heating resistor.

FIG. 9 shows thermal process temperature dependencies of etching rates.

When the heating resistor is made of Ta—Si—O, the etching rate is as substantially constant the 1 nm/sec. until 900° C. and, when the temperature exceeds 900° C., the etching rate starts to decrease. When the temperature exceeds 940° C. that is the softening point of the glaze, the etching rate extremely drops, thus substantially disabling the etching.

When the heating resistor is made of Nb—Si—O, the etching rate varies slowly, but when the temperature exceeds 940° C. that is the softening point of the glaze, the etching rate extremely drops, thus substantially disabling the etching.

Thereafter, at least heating parts of these samples were covered with respective protective films of Si—O—N, and further subjected to respective mounting steps to prepare thermal print heads for use in plate-making machines having the heating resistors of dimensions of 40 $\mu$m in the feed or sub-scanning direction and 30 $\mu$m in the main scanning direction and having a resolution of 400 dots/inch.

Continually applied to these thermal print heads were pulses under drive conditions of a power of 0.25 W/dot, a pulse width of 0.5 msec., and a pulse period of 3.0 msec. to examine a transition of the resistive value change rate.

Figure 10:
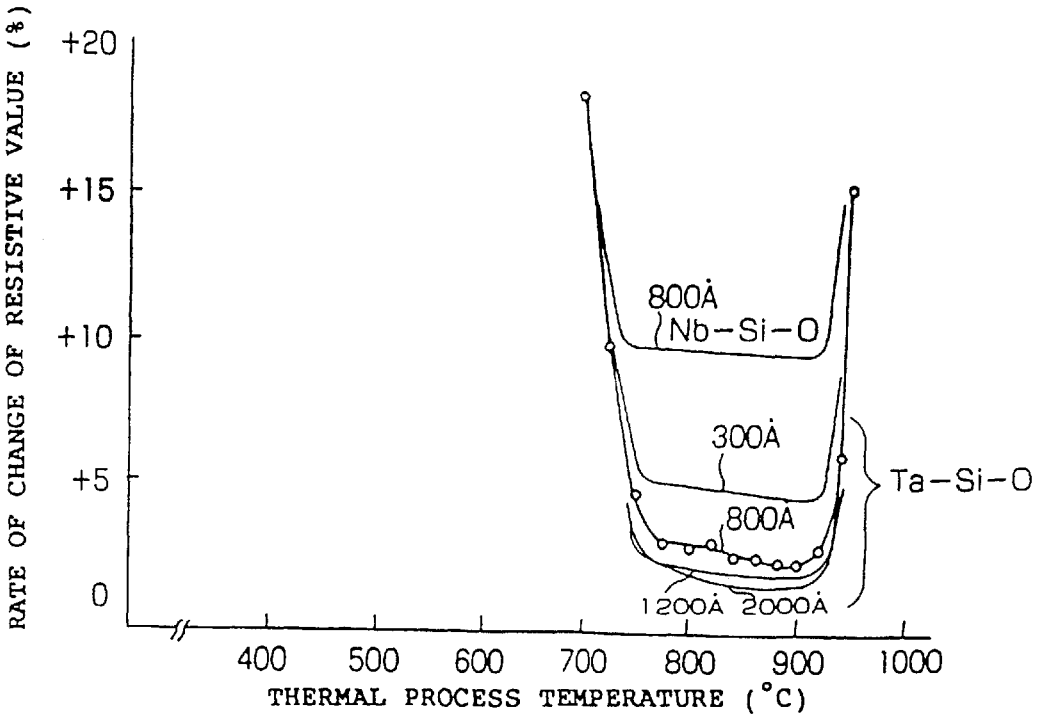
FIG. 10 shows a relationship between the thermal process temperature of the heating resistor and anti-pulse life experimental results of the thermal print head.

The examination results are given in FIG. 10. Abscissa denotes thermal process temperature and ordinate denotes resistive value change rate when the number of pulse impression is $1.0\times10^8$ cycles. In the present experiment, the heating resistor temperature reached 780° C. as a peak temperature. With respect to the sample subjected to the thermal process at a temperature less than 700° C., since the resistive value change rate exceeded +20% before the pulse impression number of $1\times10^8$ cycles, its experiment was interrupted. The resistive value change rate abruptly decreases in a temperature range of 700 to 750° C. When the temperature exceeds 750° C. that is the glass transition point of the glaze, the tendency of the decrease of the resistive value change rate continues though its gradient is small. When the temperature exceeds 800° C. that is the yield point of the glaze, the tendency is further strengthened. However, when the temperature exceeds 940° C. of the softening point of the glaze, the change rate abruptly increases.

It has been seen from the above result that the thermal print head, which was subjected to the thermal process at the temperature of above the glass transition point of the glaze and below the softening point thereof, in particular, at the temperature above the yield point and below softening point, exhibits excellent characteristics.

EXAMPLE 6:

Samples were subjected to a thermal process in the same manner as in the Example 1 except that a glaze had a glass transition point of 670° C., a yield point of 710° C. and a softening point of 850° C., to thereby prepare thermal print heads and to evaluate them as in the Example 1.

As a result, it has been found that, with respect to the samples subjected to the thermal process at temperatures exceeding the softening point of the glaze of 850° C., the sheet resistive value variation increase rate extremely increases, the sheet resistive value change rate also has a positive value with a very large differential coefficient, the surface roughness Ra also largely increases beyond 0.1 μm, and the resistive value change rate becomes very large in anti-pulse life experiments. It has also been found that the samples subjected to the thermal process in a temperature range of the yield point of 710° C. to the softening point of 850° C. exhibit, in particular, excellent anti-pulse life characteristics.

Meanwhile, it has been found that, with respect to the samples subjected to the thermal process at temperatures less than the glass transition point of the glaze of 670° C., the sheet resistive value change rate is large in its differential coefficient and is very large even in the anti-pulse life experiments.

EXAMPLE 7:

A glaze layer having a thickness of 40 μm was provided as a substrate onto an alumina supporting substrate (having a size of 275×55×1.0 mm) 1 (see FIG. 5) containing 97 wt % of $Al_2O_3$. The starting material of the glaze contains $SiO_2$, SrO and $Al_2O_3$ as main components and $La_2O_3$, BaO, $Y_2O_3$ and CaO as other components to realize compatibility between the heat resistance and smoothness. After the starting material was melted at a temperature of 1500° C., the material was quickly cooled to form a quench glass, the quench glass was finely crushed by a ball mill, coated on the alumina supporting substrate, and then baked at a temperature of 1200° C. The glaze had a glass transition point of 750° C. and a softening point of 940° C.

Formed on the glaze by an RF sputtering process was a heating resistor layer which comprises Ta—Si—O. Targets were made in the form of a sintered mixture body made of 47 mol % of Ta and 53 mol % of $SiO_2$; an Ar pressure was 1.1 Pa, an RF power density was 3.5 W/cm$^2$, a resistivity was 12 mΩ·cm, and a film thickness was 90 nm.

Next, the samples were subjected to a thermal process for 15 minutes at a temperature of 800° C. in vacuum. Thereafter, the sample was subjected to a forming process of Al electrodes, and then subjected to a photoengraving process for patterning. After formation of an SiON protective film, the sample was further subjected to a mounting step to thereby prepare a thermal print head for use in plate-making machine having heating resistor dimensions of 40 μm in the sub-scanning direction and 30 μm in the main scanning direction and having a resolution of 400 dots/inch. The obtained thermal print head is denoted by sample C.

Another thermal print head was prepared in the same manner as in the sample C except that the vacuum thermal process temperature was set at 950° C., and was denoted by sample D. However, the sample D had a problem that the resistive value variation after the vacuum thermal process was increased 5 to 7 times of that before the vacuum thermal process. The surface smoothness of the heating resistor was also lost and the surface smoothness of the electrodes formed on the heating resistor was also lost under the influence of the former's loss of smoothness, thereby making it difficult to effect wire bonding in its mounting step.

A thermal print head was manufactured in the same manner as in the sample C except that, in place of the vacuum thermal process, the heating resistor was subjected to an electrical aging process after formation of a protective film, and the resultant thermal print head was named a sample E.

Cross-sections of the samples C to E were analyzed by a micro Auger electron spectroscopy (AES) to measure oxygen concentrations in the films.

Figure 12:
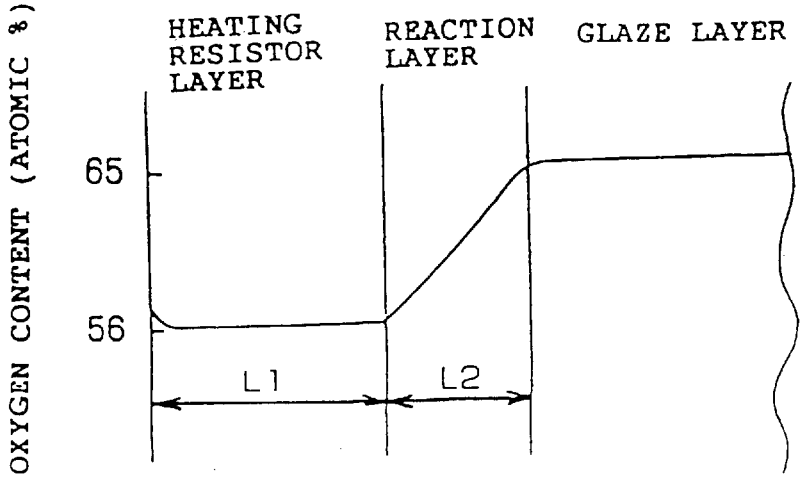
FIG. 12 shows oxygen contents in the heating resistor layer, reaction layer and glaze layer which collectively form the thermal print head of the embodiment of the present invention.

The results are shown in Table 1 and FIG. 12.

In any of the samples, the oxygen content in the heating resistor layer was 56 atomic % and the oxygen content in the glaze layer was as nearly constant as 65 atomic %.

Further in all the samples, the oxygen content in the reaction layers continuously decreased from side of the glaze layer to the side of the heating resistor layer.

However, when the heating resistor layer is set to have a thickness L1, the reaction layer is to have a thickness L2 and the glaze layer is to have a thickness L3, as shown in Table 1, L2/L1 was ⅕ for the sample C, ½ for the sample D and 1/44 for the sample E.

Figure 11:
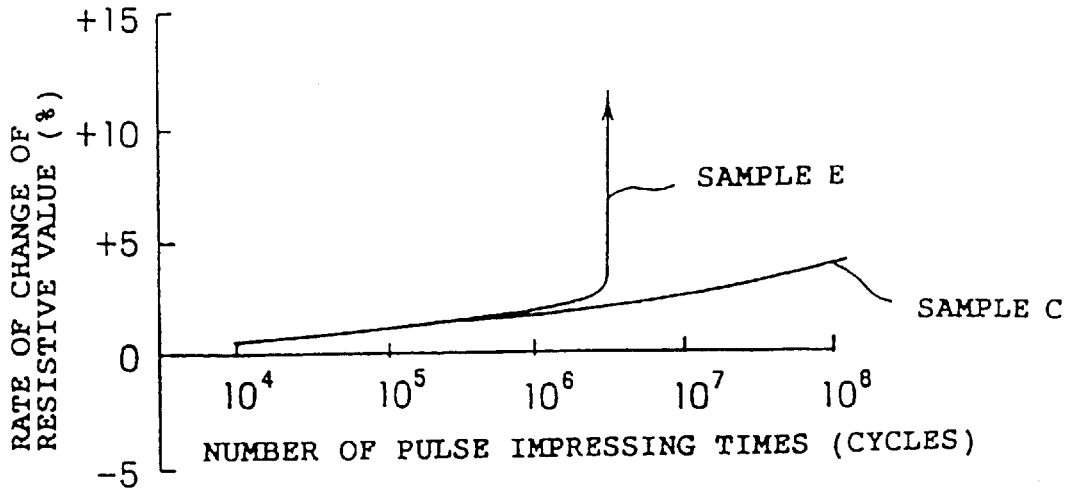
FIG. 11 shows anti-pulse life experimental results of comparative samples of the thermal print head in accordance with the embodiment of the present invention.

The samples C and E in the form of thermal print heads were subjected to an anti-pulse life experiment. The experiment conditions were that pulses with a power of 0.29 W/dot, a pulse width of 0.5 msec. and a pulse period of 3.0 msec. were applied to the thermal print heads to examine a transition of their resistive value change rate. The examination results are given in FIG. 11.

With regard to the sample C, the resistive value tends to increase from the beginning, and the resistive value change rate remains +3% and stable even at a point of pulse impression number of $10^8$ cycles.

Meanwhile, the sample E is not so different from the sample C in the resistive value change rate until $3\times10^6$ cycles, but thereafter shows an abrupt increase. This is because the heating resistor layer was released or peeled off from the glaze layer.

TABLE 1

| | L1 | L2 | L2/L1 |
|---|---|---|---|
| Sample C | 75 nm | 15 nm | 1/5 |
| Sample O | 60 nm | 30 nm | 1/2 |
| Sample E | 88 nm | 2 nm | 1/44 |

As has been explained in the foregoing, in accordance with the present invention, when the predetermined reaction layer is disposed between the heating resistor layer and the glaze layer, the adhesion between the both layers can be enhanced and therefore the heating resistor layer can be prevented from the release resulting from thermal stress based on the pulse impression. Further, the reaction layer also has a function of suppressing diffusing intrusion of the glaze components into the heating resistor layer. Therefore, a thermal print head in which the heating resistor is especially high in its heating temperature can be provided with an excellent resistive value stability and a long life characteristic.

As has been mentioned above, in accordance with the present invention, there can be provided a thermal print head in which the variation of the heating resistor varies less, its surface smoothness and anti-pulse property are excellent, thus expecting a good life characteristic. The thermal print head is usable in facsimile machines, word processor printers, plate-making machines, etc., and can be suitably employed especially as a thermal print head designed for stencil printing having a high definition of some 400 dpi or more.

What is claimed is:

1. A resistor made of a cermet material containing Si, O and a metal, wherein said resistor has an unpaired electron density of $1.0\times10^{19}$ spins/cm$^3$ or less.

2. A resistor as set forth in claim 1, wherein said resistor has an unpaired electron density of $1.0\times10^{18}$ spins/cm$^3$ or less.

3. A resistor as set forth in claim 1, wherein said metal is at least one selected from a group consisting of Ta, Nb, Cr, Ti, W and V.

4. A resistor as set forth in claim 3, wherein said resistor has an unpaired electron density of $1.0\times10^{18}$ spins/cm$^3$ or less.

5. A thermal print head comprising:

a supporting substrate;

a heating resistor formed on said supporting substrate and made of a cermet material containing Si, O and a metal; and an electrode formed on said heating resistor, wherein said resistor has an unpaired electron density of $1.0\times10^{19}$ spins/cm$^3$ or less.

6. A thermal print head as set forth in claim 5, wherein said resistor has an unpaired electron density of $1.0\times10^{18}$ spins/cm$^3$ or less.

7. A thermal print head as set forth in claim 5, wherein said metal is at least one selected from a group consisting of Ta, Nb, Cr, Ti, W and V.

8. A thermal print head as set forth in claim 7, wherein said resistor has an unpaired electron density of $1.0\times10^{18}$ spins/cm$^3$ or less.

9. A thermal print head comprising:

a supporting substrate;

a glaze layer formed on said supporting substrate;

a heating resistor formed on said glaze layer and made of a cermet material containing Si, O and a metal; and an electrode formed on said heating resistor, wherein said heating resistor has an unpaired electron density of $1.0\times10^{19}$ spins/cm$^3$ or less.

10. A thermal print head as set forth in claim 9, wherein said metal is at least one selected from a group consisting of Ta, Nb. Cr, Ti, W and V.

11. A thermal print head as set forth in claim 9 or 10, wherein said resistor has an unpaired electron density of $1.0\times10^{18}$ spins/cm$^3$ or less.

12. A method for manufacturing a thermal print head comprising a supporting substrate, a glaze layer, a heating resistor, and an electrode provided on said heating resistor, the method comprising the steps of:

forming the glazed layer on the supporting substrate;

sputtering a cermet material containing Si, O and a metal on the glazed layer to form the heating resistor;

heat-treating the heating resistor at a temperature in a range of from a glass transition point of said glaze layer to a softening point thereof to cause the heating resistor so that the heating resistor has an unpaired electron density of $1.0\times10^{19}$ spins/cm$^3$ or less; and forming the electrode layer on the heating resistor.

13. (Amended) A thermal print head comprising:

a supporting substrate;

a glaze layer formed on said supporting substrate;

a heating resistor formed on said glaze layer and made of a cermet material containing Si, O and a metal; and an electrode formed on said heating resistor, wherein the supporting substrate having said glaze layer and said heating resistor thereon is heat-treated at a temperature of not less than a glass transition point of said glaze layer and not more than a softening point thereof.

14. A thermal print head as set forth in claim 13, wherein said heating resistor is operated at a temperature of not less than the glass transition point of the glaze layer at the time of driving the heating resistor.

15. A thermal print head as set forth in claim 13, wherein the supporting substrate having said glaze layer and heating resistor thereon is heat-treated at a temperature of not less than a yield point of said glaze layer and not more than the softening point thereof.

16. A thermal print head comprising:

a supporting substrate;

a glaze layer formed on said supporting substrate;

a heating resistor formed on said glaze layer; and an electrode formed on said heating resistor, wherein an interfacial mixing layer is formed between said glaze layer and said heating resistor, the interfacial mixing layer being a reaction layer produced by heat-treating the heating resistor formed on the glazed layer, and wherein an oxygen content in said heating resistor is in a range of 40 to 70 atomic %, an oxygen content in said glaze layer is in a range of 50 to 80 atomic %, and an oxygen content in said reaction layer continuously decreases from a surface contacted with said glaze layer to another surface contacted with said heating resistor.

17. A thermal print head as set forth in claim 16, wherein said heating resistor is made of a cermet material selected from the group consisting of a first material consisting essentially of Ta, Si and O and a second material consisting essentially of Ta, Si, O and C.

18. A thermal print head as set forth in claim 16, wherein a thickness of said reaction layer is in a range of 1/30 to 1/3 of a thickness of said heating resistor.

19. A method for manufacturing a thermal print head comprising the steps of:

coating a glaze material on one surface of a supporting substrate and baking the coated supporting substrate to form a glaze layer;

sputtering a cermet material on the glaze layer to form a heating resistor; and heat-treating the supporting substrate having said glaze layer and heating resistor thereon at a temperature in a range of not less than a glass transition point of said glaze layer and not more than a softening point thereof to form a reaction layer between the glaze layer and the heating resistor.

20. A method for manufacturing a thermal print head as set forth in claim 19, wherein the heat-treating temperature is in a range of not less than a yield point of said glaze layer and not more than the softening point thereof.

21. A method for manufacturing a thermal print head as set forth in claim 19 or 20, wherein said heating resistor has a thickness of 0.1 $\mu$m or less.

* * * * *